US008873790B2

(12) United States Patent
Hayashida et al.

(10) Patent No.: US 8,873,790 B2
(45) Date of Patent: Oct. 28, 2014

(54) NON-OCCLUDING EARBUDS AND METHODS FOR MAKING THE SAME

(75) Inventors: Jeffrey Hayashida, San Francisco, CA (US); Jonathan Aase, Redwood City, CA (US); Julian Hoenig, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 383 days.

(21) Appl. No.: 13/175,588

(22) Filed: Jul. 1, 2011

(65) Prior Publication Data

US 2013/0004011 A1 Jan. 3, 2013

(51) Int. Cl.

| | |
|---|---|
| ***H04R 25/00*** | (2006.01) |
| ***H04R 1/28*** | (2006.01) |
| ***H04R 1/10*** | (2006.01) |
| ***H04R 1/34*** | (2006.01) |
| ***H04R 31/00*** | (2006.01) |
| *H04R 1/26* | (2006.01) |

(52) U.S. Cl.

CPC ..... *H04R 1/1016* (2013.01); *H04R 1/2811* (2013.01); *H04R 1/345* (2013.01); *H04R 1/26* (2013.01); *H04R 2460/09* (2013.01); *H04R 31/006* (2013.01)

USPC ..... 381/370; 381/374; 381/377

(58) Field of Classification Search

USPC ..... 381/370–380

See application file for complete search history.

(56) References Cited

U.S. PATENT DOCUMENTS

| | | | | |
|---|---|---|---|---|
| 7,319,762 | B2 * | 1/2008 | Andrea et al. | 381/74 |
| 7,570,777 | B1 | 8/2009 | Taenzer et al. | |
| 2007/0286446 | A1 | 12/2007 | Yang | |
| 2009/0052702 | A1 | 2/2009 | Murphy et al. | |
| 2012/0087532 | A1 * | 4/2012 | Yang | 381/380 |

FOREIGN PATENT DOCUMENTS

| | | |
|---|---|---|
| EP | 1318692 | 6/2003 |
| EP | 1608204 | 12/2005 |

* cited by examiner

*Primary Examiner* — Davetta W Goins
*Assistant Examiner* — Amir Etesam
(74) *Attorney, Agent, or Firm* — Van Court & Aldridge LLP

(57) ABSTRACT

Non-occluding earbuds and methods for making the same are disclosed. The earbud has a non-occluding housing having a directional port positioned offset with respect to a center axis of the housing. The directional port may be constructed to project acoustic signals into the user's ear canal. In addition, the directional port can include separate openings or ports for different front volumes existing within the housing. Front and back volumes can exist for each speaker contained within the housing, and embodiments of this invention use a midmold structure that enables the front volumes to be tuned independently of each other.

23 Claims, 9 Drawing Sheets

NON-OCCLUDING EARBUDS AND METHODS FOR MAKING THE SAME

BACKGROUND

Headsets are commonly used with many portable electronic devices such as portable music players and mobile phones. Headsets can include non-cable components such as a jack, headphones, and/or a microphone and one or more cables that interconnect the non-cable components. Other headsets can be wireless. The headphones—the component that generates sound—can exist in many different form factors such as over-the-ear headphones or as in-the-ear or in-the-canal earbuds. In-the-ear earbuds are sometimes referred to as non-occluding earbuds as they generally do not form an airtight seal with the user's ear. The absence of an airtight seal can affect the earbud's acoustic performance, especially when two or more speakers are used. Accordingly, what is needed is a non-occluding earbud having two or more speakers and that provides high quality sound.

SUMMARY

Non-occluding earbuds and methods for making the same are disclosed. The earbud has a non-occluding housing having a directional port positioned offset with respect to a center axis of the housing. The directional port may be constructed to project acoustic signals into the user's ear canal. In addition, the directional port can include separate openings or ports for different front volumes existing within the housing. Front and back volumes can exist for each speaker contained within the housing, and embodiments of this invention use a midmold structure that enables the front volumes to be tuned independently of each other. The speakers are mounted to the midmold, which is fixed to an inner surface of the housing. The midmold has a cavity shaped to tune the front volume of one of the speakers. For example, in one embodiment, the cavity can form part of the front volume for a woofer speaker.

BRIEF DESCRIPTION OF THE DRAWINGS

The above and other aspects and advantages of the invention will become more apparent upon consideration of the following detailed description, taken in conjunction with accompanying drawings, in which like reference characters refer to like parts throughout, and in which.

DETAILED DESCRIPTION OF THE DISCLOSURE

Figure 1B:
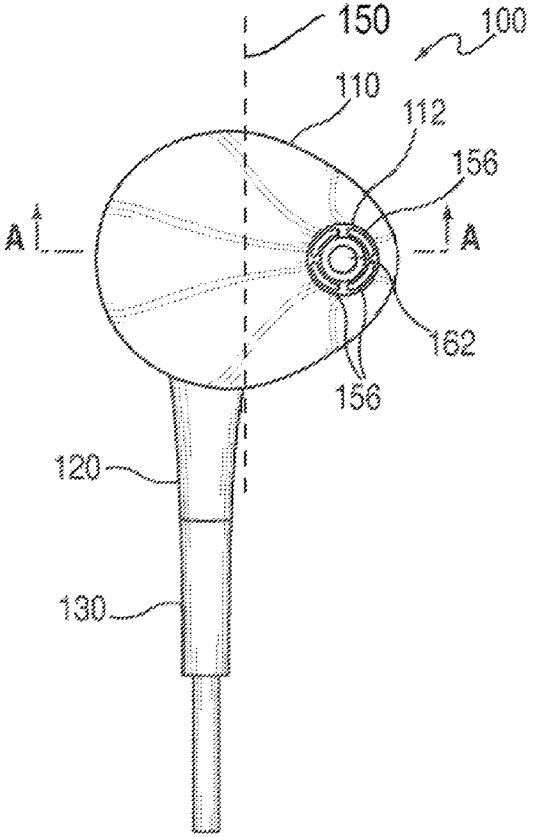
FIGS. 1A-D show illustrative views of an earbud in accordance with an embodiment of the invention.
Figure 1A:
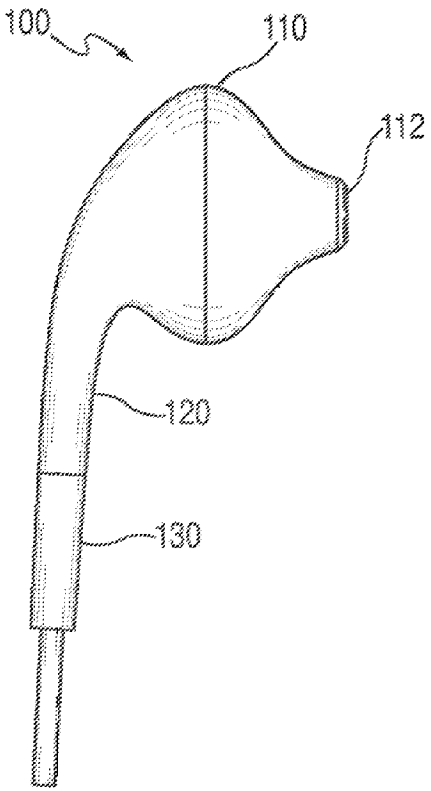
Figure 1D:
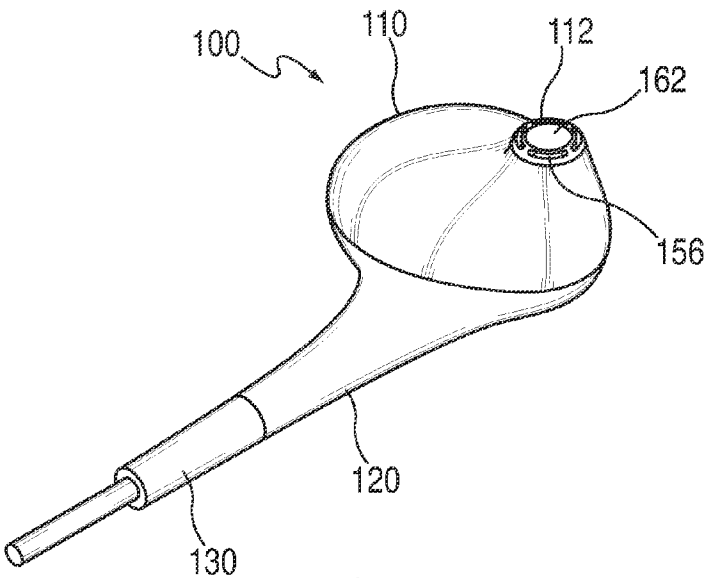
Figure 1C:
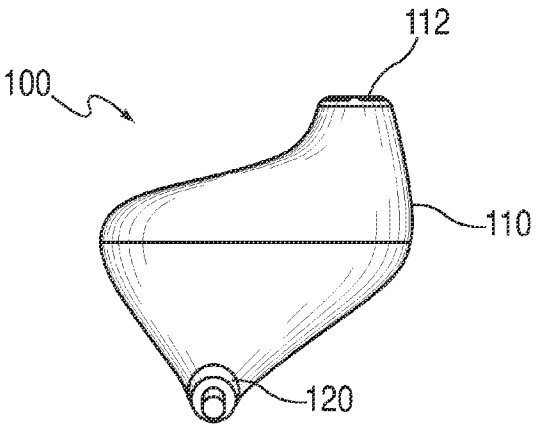

Headphones or earbuds for use in headsets are disclosed. Earbuds according to embodiments of this invention include a non-occluding housing having a directional port offset with respect to a center axis of the earbud. The housing can have an asymmetric shape amenable to in-the-ear retention, but does not form an air-tight seal with the user's ear or ear canal. The absence of an air-tight seal requires that the front volume for each speaker (or dynamic driver) be specifically tuned to achieve a desired frequency response. Embodiments of this invention use a midmold structure within the housing to form a portion of the front volume for at least one of the speakers. The midmold is fixed to an inner surface of the housing and has its internal cavity shaped to provide a desired front volume for a speaker, regardless of the shape of the housing.

FIGS. 1A-D show several illustrative views of earbud 100 in accordance with an embodiment of the invention. In particular, FIGS. 1A-D show side, front, top, and perspective views of earbud 100, respectively. As shown, earbud 100 is a non-occluding earbud that is asymmetrically shaped along at least two orthogonal axes. Earbud 100 includes non-occluding member 110, directional port 112, neck member 120, and strain relief member 130. Directional port 112 is positioned offset with respect to center axis 150. Directional port 112 is offset so that when earbud 100 is placed in a user's ear, directional port 112 is positioned to direct sound directly into the user's ear canal. Earbud 100 can also include one or more speakers, a mid-mold, and a printed circuit board (none of which are shown).

Non-occluding member 110 is designed to fit in the ear of a user in a non-occluding manner. Non-occluding earbuds are generally designed not to form an airtight seal between the ear (or ear canal) and the outer surface of the earbud. By way of contrast, occluding earbuds are generally designed to fit inside of the user's ear canal and form a substantially airtight seal. The absence of an air-tight seal requires that the front volume for each speaker (or dynamic driver) be specifically tuned to achieve a desired frequency response.

Non-occluding member 110 can include two parts that are coupled together and cosmetically finished to provide the illusion that member 100 is a single piece construction. The two-part construction of member 110 is needed so that a speaker subassembly (e.g., an assembly including a midmold, speakers, and circuitry) can be installed in earbud 100.

In embodiments of this invention, the front volumes of each speaker are isolated from each other within the housing. This provides for easier tuning of each speaker. Although acoustic signals generated by each speaker are isolated from each other when passing through their respective front volumes, the signals may mix when they pass through directional port 112, and in particular, through ports 156 and 162 (also shown in FIG. 2), which form part of directional port 112. Ports 156 and 162 can take any suitable shape and can include one or more ports. As shown, port 162 can be annular in shape and surrounded by one or more of ports 156.

Figure 2:
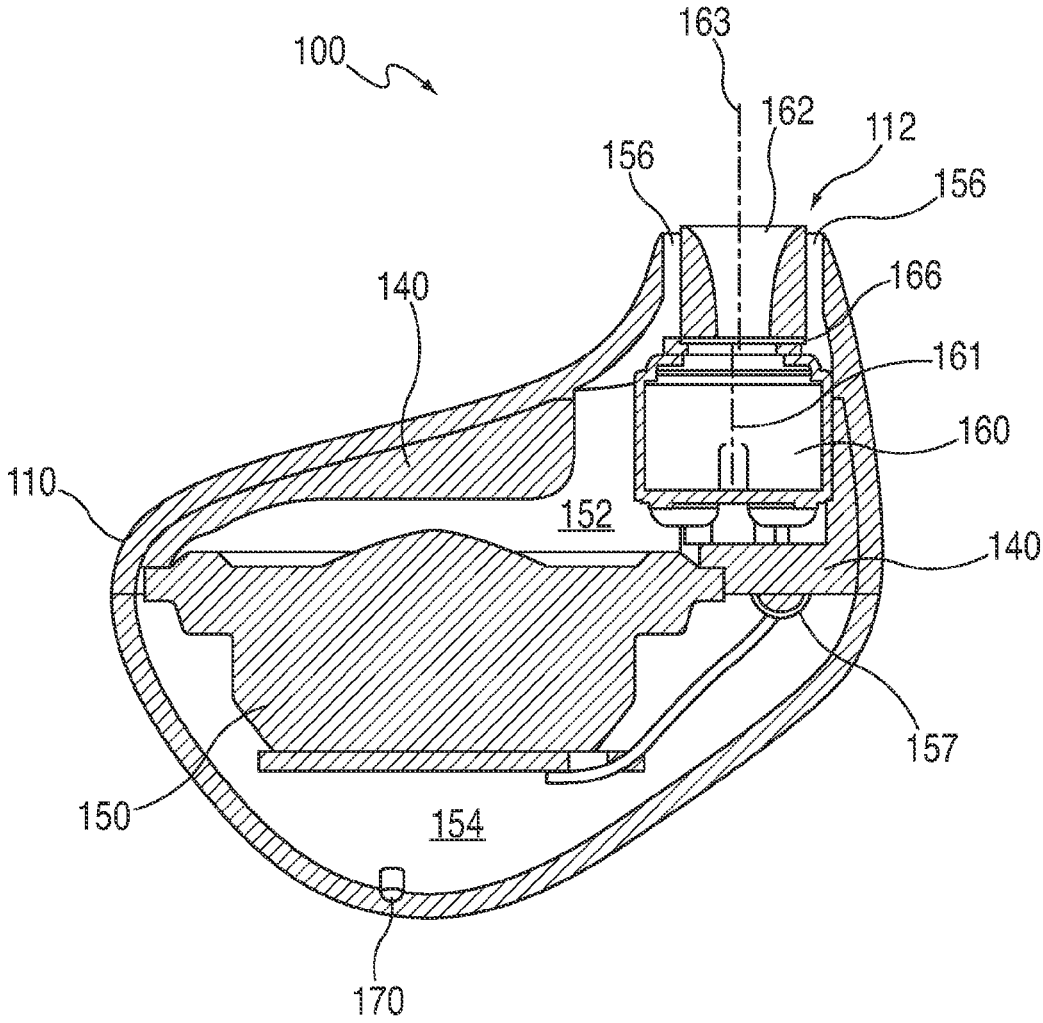
FIG. 2 shows an illustrative cross-sectional view of the earbud of FIG. 1 in accordance with an embodiment of the invention.

FIG. 2 shows a cross-sectional view of earbud 100 taken along lines A-A of FIG. 1B. As shown, earbud 100 includes midmold 140, woofer 150, front volume 152, back volume 154, and tweeter 160. Both woofer 150 and tweeter 160 are fixed to midmold 140 as shown. Midmold 140 is fixed to an inner surface of housing 110 and has a cavity to provide front volume 152 for woofer 150. Midmold 140 can be constructed to provide front volume 152 of any predetermined size, regardless of the shape of housing 110. Front volume 152 is acoustically isolated from back volume 154 and tweeter 160. Sealant 157 further ensures that front volume 152 is isolated from back volume 154 even though conductors are routed through conductor vias (not shown) extending through midmold 140. Back volume 154 may be exposed to an ambient environment via port 170.

Tweeter 160 is operative to project acoustic energy through tweeter port 162, which forms part of directional port 112.

Center axis 161 of tweeter 160 may be aligned offset with respect to center axis 163 of tweeter port 162. In another embodiment, axes 161 and 163 can be co-linearly aligned. Acoustic energy provided by woofer 150 can be projected through one or more woofer ports 156, which also form part of directional port 112 and which are also disposed around tweeter port 162.

Tweeter port 162 can be a hollow-shaped structure such as a cylinder that extends into housing 110 towards tweeter 160. The structure engages seal 166 which couples port 162 to tweeter 160. Seal 166 may be any suitable seal such as a compressible seal. When tweeter 160 is coupled to port 162, the free space existing within the port structure forms part of the tweeter's front volume.

Figure 3A:
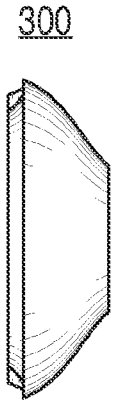
FIGS. 3A-F show several illustrative views of a midmold in accordance with an embodiment of the invention.
Figure 3B:
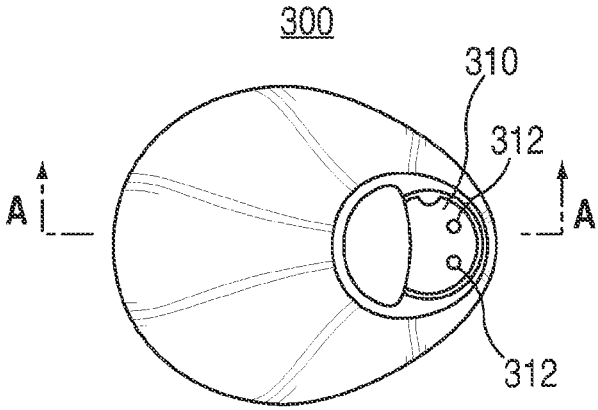
Figure 3C:
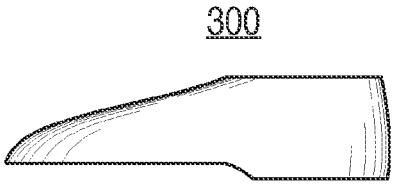
Figure 3D:
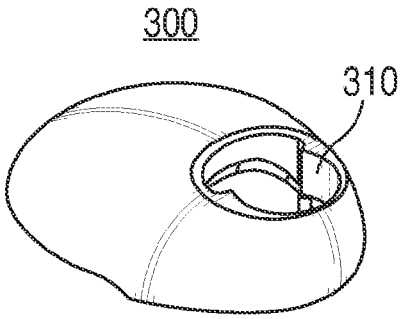
Figure 3E:
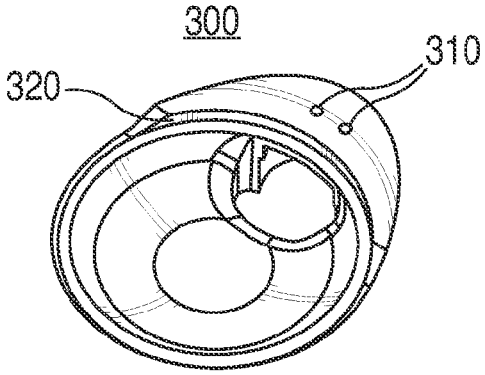
Figure 3F:
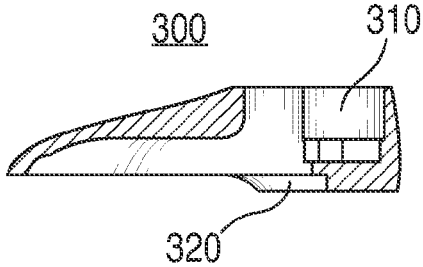

Referring now to FIGS. 3A-F, several illustrative views of a midmold constructed in accordance with an embodiment of the invention are shown. In particular, FIGS. 3A-E show illustrative side, top, front, top perspective, and bottom perspective views of midmold 300, respectively. FIG. 3F shows an illustrative cross-sectional view taken along line A-A of FIG. 3B. Midmold 300 has first recess 310 for receiving a tweeter (e.g., tweeter 160 of FIG. 2) and conductor vias 312 for enabling passage of conductors therethrough. Midmold 300 has second recess 320 for receiving a woofer (e.g., woofer 150 of FIG. 2). Midmold 300 can be constructed from a plastic such as a thermoplastic and can be injection molded.

Figure 4A:
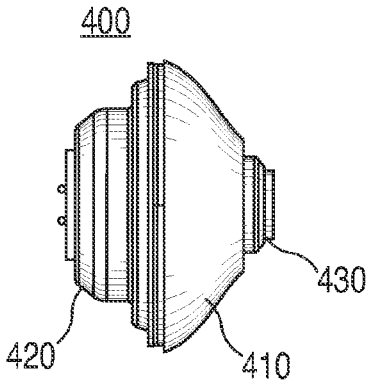
FIGS. 4A-E show illustrative views of a sub-assembly in accordance with an embodiment of the invention.
Figure 4B:
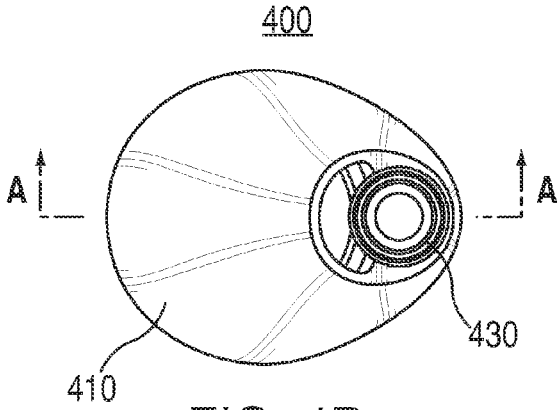
Figure 4C:
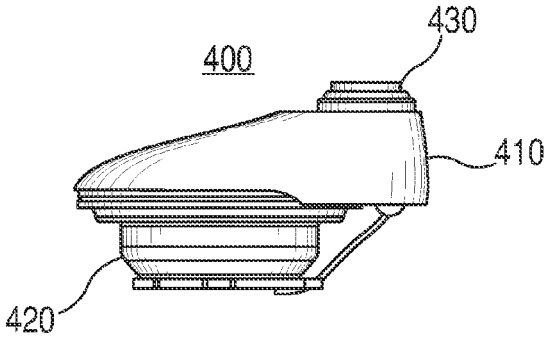
Figure 4D:
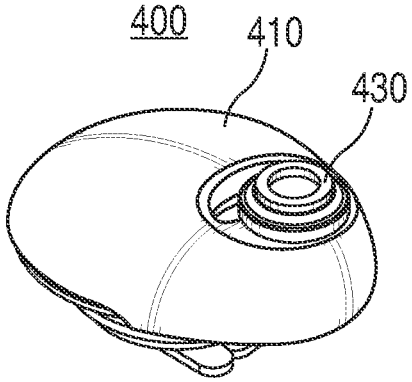
Figure 4E:
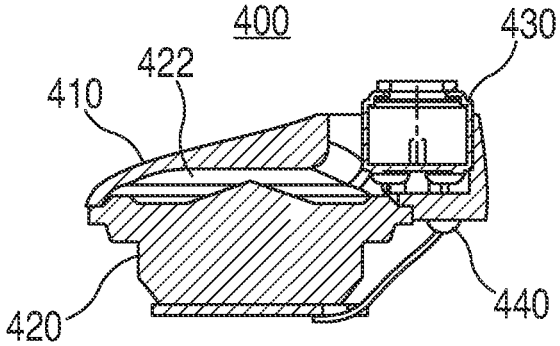

Referring now to FIGS. 4A-E, several illustrative views of subassembly 400 including midmold 410, woofer 420, and tweeter 430, are shown. In particular, FIGS. 4A-D show side, top, front, and perspective views of subassembly 400, respectively. FIG. 4E shows an illustrative cross-sectional view taken along line A-A of FIG. 4B. When woofer 420 is fixed to midmold 410, front volume 422 is provided in the space existing between midmold 410 and woofer 420. To ensure front volume 422 is acoustically isolated from a back volume (not shown), glue 440 may be disposed over conductor vias (not shown) to ensure no leakage exists where the tweeter conductors pass through midmold 410.

Figure 5:
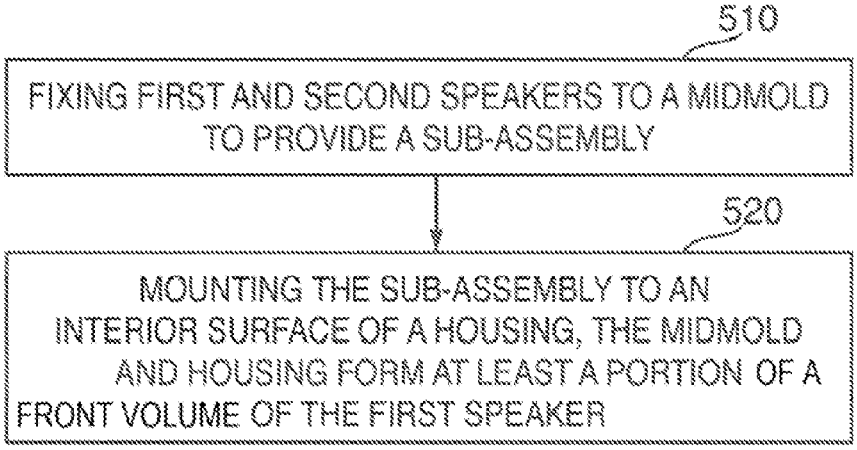
FIG. 5 shows an illustrative process of an embodiment of the invention.

FIG. 5 shows an illustrative process for manufacturing an earbud according to an embodiment of the invention. Starting with step 510, a sub-assembly is provided by fixing first and second speakers to a midmold. The midmold can be, for example, midmold 140 of FIG. 2 and the first and second speakers can be a woofer and a tweeter, respectively. Conductors may be routed through one or more conductor vias existing in the midmold and connected to one or both of the speakers.

At step 520, the sub-assembly is mounted to an interior surface of a housing, the midmold and housing forming at least a portion of a front volume of the first speaker. The housing may be, for example, housing 110 of FIGS. 1 and 2, and includes a directional port. When the sub-assembly is mounted within the housing, an acoustic seal is formed between the second speaker and a portion of the directional port. The directional port and seal form a front volume for the second speaker.

Earbuds according to embodiments of the invention can be included as part of a headset such as a wired headset or a wireless headset. An example of a wired headset is discussed below in connection with the description accompanying FIGS. 6A & 6B. A wireless headset can include, for example, a Bluetooth headset.

Figure 6A:
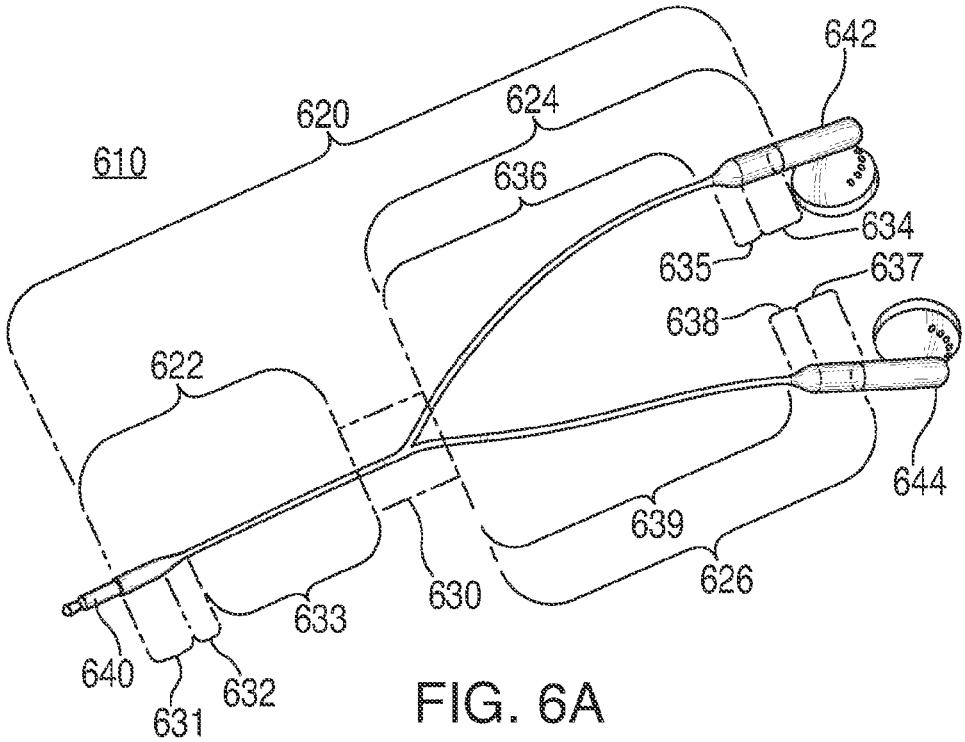
FIGS. 6A-B show illustrative views of wired headsets in accordance with embodiments of the invention.

FIG. 6A shows an illustrative headset 600 having cable structure 620 that seamlessly integrates with non-cable components 640, 642, 644. For example, non-cable components 640, 642, and 644 can be a male plug, left headphones, and right headphones, respectively. As a specific example, components 642 and 644 can be an earbud having a midmold based subassembly contained therein according to embodiments of the invention. Cable structure 620 has three legs 622, 624, and 626 joined together at bifurcation region 630. Leg 622 may be referred to herein as main leg 622, and includes the portion of cable structure 620 existing between non-cable component 640 and bifurcation region 630. In particular, main leg 622 includes interface region 631, bump region 632, and non-interface region 633. Leg 624 may be referred to herein as left leg 624, and includes the portion of cable structure 620 existing between non-cable component 642 and bifurcation region 630. Leg 626 may be referred to herein as right leg 626, and includes the portion of cable structure 620 existing between non-cable component 644 and bifurcation region 630. Both left and right legs 624 and 626 include respective interface regions 634 and 637, bump regions 635 and 638, and non-interface regions 636 and 639.

Legs 622, 624, and 626 generally exhibit a smooth surface throughout the entirety of their respective lengths. Each of legs 622, 624, and 626 can vary in diameter, yet still retain the smooth surface.

Non-interface regions 633, 636, and 639 can each have a predetermined diameter and length. The diameter of non-interface region 633 (of main leg 622) may be larger than or the same as the diameters of non-interface regions 636 and 639 (of left leg 624 and right leg 626, respectively). For example, leg 622 may contain a conductor bundle for both left and right legs 624 and 626 and may therefore require a greater diameter to accommodate all conductors. In some embodiments, it is desirable to manufacture non-interface regions 633, 636, and 639 to have the smallest diameter possible, for aesthetic reasons. As a result, the diameter of non-interface regions 633, 636, and 639 can be smaller than the diameter of any non-cable component (e.g., non-cable components 640, 642, and 644) physically connected to the interfacing region. Since it is desirable for cable structure 620 to seamlessly integrate with the non-cable components, the legs may vary in diameter from the non-interfacing region to the interfacing region.

Bump regions 632, 635, and 638 provide a diameter changing transition between interfacing regions 631, 634, and 637 and respective non-interfacing regions 633, 636, and 639. The diameter changing transition can take any suitable shape that exhibits a fluid or smooth transition from any interface region to its respective non-interface region. For example, the shape of the bump region can be similar to that of a cone or a neck of a wine bottle. As another example, the shape of the taper region can be stepless (i.e., there is no abrupt or dramatic step change in diameter, nor a sharp angle at an end of the bump region). Bump regions 632, 635, and 638 may be mathematically represented by a bump function, which requires the entire diameter changing transition to be stepless and smooth (e.g., the bump function is continuously differentiable).

Interface regions 621, 634, and 637 can each have a predetermined diameter and length. The diameter of any interface region can be substantially the same as the diameter of the non-cable component it is physically connected to, to provide an aesthetically pleasing seamless integration. For example, the diameter of interface region 621 can be substantially the same as the diameter of non-cable component 640. In some embodiments, the diameter of a non-cable component (e.g., component 640) and its associated interfacing region (e.g., region 631) are greater than the diameter of the non-interface region (e.g., region 633) they are connected to via the bump region (e.g., region 632). Consequently, in this embodiment, the bump region decreases in diameter from the interface region to the non-interface region.

In another embodiment, the diameter of a non-cable component (e.g., component 640) and its associated interfacing region (e.g., region 631) are less than the diameter of the non-interface region (e.g., region 633) they are connected to via the bump region (e.g., region 632). Consequently, in this embodiment, the bump region increases in diameter from the interface region to the non-interface region.

The combination of the interface and bump regions can provide strain relief for those regions of headset 610. In one embodiment, strain relief may be realized because the interface and bump regions have larger dimensions than the non-interface region and thus are more robust. These larger dimensions may also ensure that non-cable portions are securely connected to cable structure 620. Moreover, the extra girth better enables the interface and bump regions to withstand bend stresses.

The interconnection of legs 622, 624, and 626 at bifurcation region 630 can vary depending on how cable structure 620 is manufactured. In one approach, cable structure 620 can be a single-segment unibody cable structure. In this approach all three legs are manufactured jointly as one continuous structure and no additional processing is required to electrically couple the conductors contained therein. That is, none of the legs are spliced to interconnect conductors at bifurcation region 630, nor are the legs manufactured separately and then later joined together. Some single-segment unibody cable structures may have a top half and a bottom half, which are molded together and extend throughout the entire unibody cable structure. For example, such single-segment unibody cable structures can be manufactured using injection molding and compression molding manufacturing processes (discussed below in more detail). Thus, although a mold-derived single-segment unibody cable structure has two components (i.e., the top and bottom halves), it is considered a single-segment unibody cable structure for the purposes of this disclosure. Other single-segment unibody cable structures may exhibit a contiguous ring of material that extends throughout the entire unibody cable structure. For example, such a single-segment cable structure can be manufactured using an extrusion process.

In another approach, cable structure 620 can be a multi-segment unibody cable structure. A multi-segment unibody cable structure may have the same appearance of the single-segment unibody cable structure, but the legs are manufactured as discrete components. The legs and any conductors contained therein are interconnected at bifurcation region 630. The legs can be manufactured, for example, using any of the processes used to manufacture the single-segment unibody cable structure.

The cosmetics of bifurcation region 630 can be any suitable shape. In one embodiment, bifurcation region 630 can be an overmold structure that encapsulates a portion of each leg 622, 624, and 626. The overmold structure can be visually and tactically distinct from legs 622, 624, and 626. The overmold structure can be applied to the single or multi-segment unibody cable structure. In another embodiment, bifurcation region 630 can be a two-shot injection molded splitter having the same dimensions as the portion of the legs being joined together. Thus, when the legs are joined together with the splitter mold, cable structure 620 maintains its unibody aesthetics. That is, a multi-segment cable structure has the look and feel of single-segment cable structure even though it has three discretely manufactured legs joined together at bifurcation region 630. Many different splitter configurations can be used, and the use of some splitters may be based on the manufacturing process used to create the segment.

Cable structure 620 can include a conductor bundle that extends through some or all of legs 622, 624, and 626. Cable structure 620 can include conductors for carrying signals from non-cable component 640 to non-cable components 642 and 644. Cable structure 620 can include one or more rods constructed from a superelastic material. The rods can resist deformation to reduce or prevent tangling of the legs. The rods are different than the conductors used to convey signals from non-cable component 640 to non-cable components 642 and 644, but share the same space within cable structure 620. Several different rod arrangements may be included in cable structure 620.

In yet another embodiment, one or more of legs 622, 624, and 626 can vary in diameter in two or more bump regions. For example, the leg 622 can include bump region 632 and another bump region (not shown) that exists at leg/bifurcation region 630. This other bump region may vary the diameter of leg 622 so that it changes in size to match the diameter of cable structure at bifurcation region 630. This other bump region can provide additional strain relief.

Figure 6B:
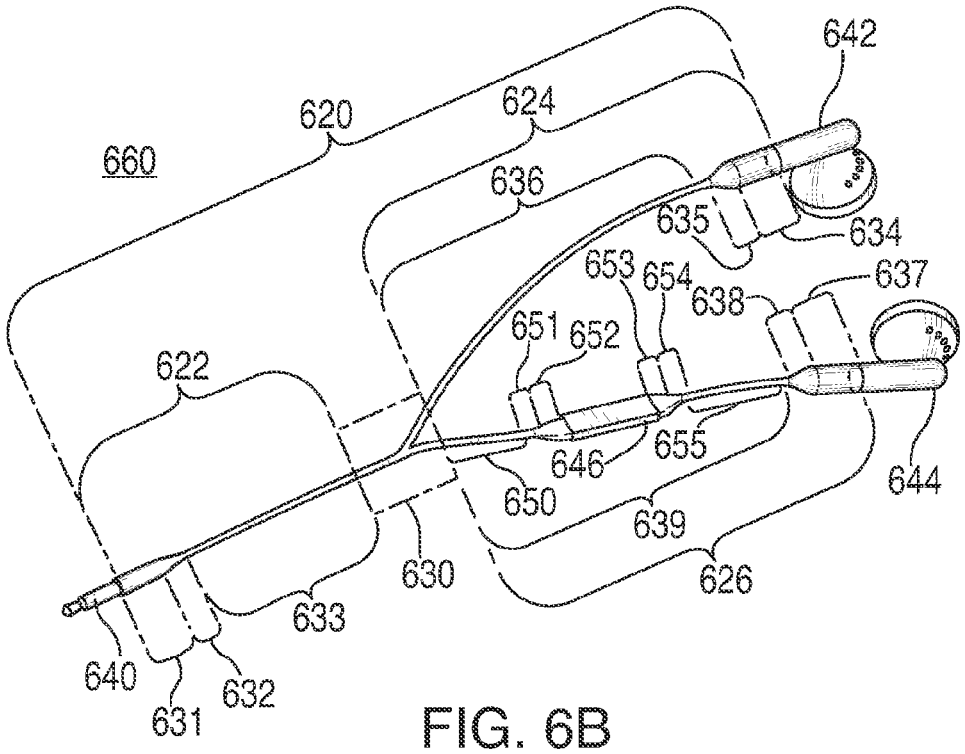

In some embodiments, another non-cable component can be incorporated into either left leg 24 or right leg 626. As shown in FIG. 6B, headset 660 shows that non-cable component 646 is integrated within leg 626, and not at an end of a leg like non-cable components 640, 642 and 644. For example, non-cable component 646 can be a communications box that includes a microphone and a user interface (e.g., one or more mechanical or capacitive buttons). Non-cable component 646 can be electrically coupled to non-cable component 640, for example, to transfer signals between communications box 646 and one or more of non-cable components 640, 642 and 644.

Non-cable component 646 can be incorporated in non-interface region 639 of leg 626. In some cases, non-cable component 646 can have a larger size or girth than the non-interface regions of leg 26, which can cause a discontinuity at an interface between non-interface region 639 and communications box 646. To ensure that the cable maintains a seamless unibody appearance, non-interface region 639 can be replaced by first non-interface region 650, first bump region 651, first interface region 652, communications box 646, second interface region 653, second bump region 654, and second non-interface region 655.

Similar to the bump regions described above in connection with the cable structure of FIG. 6A, bump regions 651 and 654 can handle the transition from non-cable component 646 to non-interface regions 650 and 655. The transition in the bump region can take any suitable shape that exhibits a fluid or smooth transition from the interface region to the non-interface regions. For example, the shape of the taper region can be similar to that of a cone or a neck of a wine bottle.

Similar to the interface regions described above in connection with the cable structure of FIG. 6A, interface regions 652 and 653 can have a predetermined diameter and length. The diameter of the interface region is substantially the same as the diameter of non-cable component 646 to provide an aesthetically pleasing seamless integration. In addition, and as described above, the combination of the interface and bump regions can provide strain relief for those regions of headset 660.

In some embodiments, non-cable component 646 may be incorporated into a leg such as leg 626 without having bump regions 651 and 654 or interface regions 652 and 653. Thus, in this embodiment, non-interfacing regions 650 and 655 may be directly connected to non-cable component 646.

Cable structures 620 can be constructed using many different manufacturing processes. The processes discussed herein include those that can be used to manufacture the single-segment unibody cable structure or legs for the multi-segment unibody cable structure. In particular, these processes include injection molding, compression molding, and extrusion. Embodiments of this invention use compression molding processes to manufacture a single-segment unibody cable structure or multi-segment unibody cable structures.

In one embodiment, a cable structure can be manufactured by compression molding two urethane sheets together to form the sheath of the cable structure. Using this manufacturing method, the finished cable structure has a bi-component sheath that encompasses a resin and a conductor bundle. The resin further encompasses the conductor bundle and occupies any void that exists between the conductor bundle and the inner wall of the bi-component cable. In addition, the resin secures the conductor bundle in place within the bi-component sheath.

The described embodiments of the invention are presented for the purpose of illustration and not of limitation.

What is claimed is:

1. An earbud, comprising:

a housing comprising non-occluding and neck members, the non-occluding member comprising a first part coupled to a second part, the first part comprising a directional port and an inner wall;

a midmold secured to the inner wall of the first part of the non-occluding member, wherein the second part is coupled to the first part to form at least a portion of the housing;

a first speaker mounted to the midmold such that a front acoustic volume and a back acoustic volume exist within the housing, the front acoustic volume interfacing with the directional port, wherein the geometry of the front acoustic volume is defined by the midmold but not by the housing; and a second speaker mounted to the midmold and acoustically isolated from the front and back volumes, the second speaker operative to direct acoustic signals directly through the directional port.

2. The earbud of claim 1, wherein the midmold is not touching any portion of the second part of the non-occluding member when the housing is formed.

3. The earbud of claim 1, wherein the non-occluding member comprises an asymmetric shape.

4. The earbud of claim 1, wherein the midmold comprises:

a first recess for receiving the second speaker; and at least one conductor via.

5. The earbud of claim 1, wherein the first speaker is a woofer and the second speaker is a tweeter.

6. The earbud of claim 1, wherein the directional port comprises a first speaker port and a second speaker port, and wherein the front volume interfaces with the first speaker port and a front volume of the second speaker interfaces with the second speaker port.

7. The earbud of claim 6, wherein the first and second speaker ports are separate.

8. The earbud of claim 1, wherein the housing comprises a port that interfaces with the back acoustic volume.

9. A non-occluding earbud, comprising:

a non-occluding housing comprising a first part and a second part coupled to the first part, the first part comprising a directional port; and a sub-assembly fixed within the housing to only the first part and not to the second part, the sub-assembly comprising at least two dynamic drivers, each one of the at least two dynamic drivers comprising respective acoustic front volumes that are isolated from each other within the housing and interface with the directional port, wherein the non-occluding housing does not form any portion of any one of the acoustic front volumes.

10. The earbud of claim 9, wherein the non-occluding housing is asymmetric.

11. The earbud of claim 9, wherein the non-occluding housing comprises a center axis and a center axis of the directional port is offset with respect to the center axis.

12. The earbud of claim 9, wherein the sub-assembly further comprises:

a midmold fixed to an inner surface of the housing, wherein the at least two drivers are mounted to the midmold, and wherein a first driver of the at least two drivers and the midmold form the acoustic front volume of the first driver.

13. The earbud of claim 12, wherein the directional port comprises at least two ports that are acoustically isolated from each other, wherein a first port of the at least two ports form part of the acoustic front volume of a second driver of the at least two drivers.

14. The earbud of claim 13, further comprising a seal that acoustically couples the first port to the second driver.

15. The earbud of claim 13, wherein the acoustic front volume of the first driver interfaces with a second port of the at least two ports.

16. The earbud of claim 9, wherein the directional port has an annular shape.

17. The earbud of claim 16, wherein the directional port comprises a concentric port and a plurality ports positioned around the concentric port.

18. A headset comprising:

a plug;

a cable structure comprising first, second, and third legs, the first leg coupled to the plug, the second leg coupled to a left non-occluding earbud, and the third leg coupled to a right non-occluding earbud; and wherein each one of the left and right non-occluding earbuds comprises:

dual dynamic drivers each comprising an independently tuned acoustic front volume that interfaces with a driver-specific port, wherein the dual dynamic drivers comprise a woofer and a tweeter;

a non-occluding housing comprising a first part and a second part coupled to the first part, the first part comprising the driver-specific ports; and a midmold that is fixed to the woofer and tweeter, the midmold and woofer forming the entirety of the front volume of the woofer.

19. The headset of claim 18, wherein the front volume and driver specific port of the woofer are acoustically separate from the front volume and driver specific port of the tweeter.

20. The headset of claim 18, wherein the housing of each earbud further comprises a housing having an asymmetric shape.

21. A method for making an earbud, comprising:

fixing first and second speakers to a midmold to provide a sub-assembly;

mounting the sub-assembly to an interior surface of a first part of a housing; and coupling the first part of the housing to a second part of the housing after the mounting, wherein the midmold and the first speaker form the entirety of a front volume of the first speaker.

22. The method of claim 21, wherein the housing comprises a non-occluding member having a directional port offset from a center axis of the housing, the method further comprising:

acoustically sealing the second speaker to a portion of the directional port to form a front volume for the second speaker.

23. The method of claim 21, wherein the midmold comprises at least one conductor via, the method further comprising:

applying a sealant to the at least one conductor via.

* * * * *